US010358921B2

(12) United States Patent
Sheppard et al.

(10) Patent No.: US 10,358,921 B2
(45) Date of Patent: Jul. 23, 2019

(54) RADIALLY EXPANSIBLE ROCK BOLT

(71) Applicant: NCM INNOVATIONS (PTY) LTD., Johannesburg (ZA)

(72) Inventors: James William Sheppard, Johannesburg (ZA); Martin Cawood, Johannesburg (ZA); Paolo Ettore Pastorino, Johannesburg (ZA)

(73) Assignee: NCM INNOVATIONS (PTY) LTD., Johannesburg (ZA)

( * ) Notice: Subject to any disclaimer, the term of this patent is extended or adjusted under 35 U.S.C. 154(b) by 0 days.

(21) Appl. No.: 15/746,215

(22) PCT Filed: Sep. 16, 2015

(86) PCT No.: PCT/ZA2015/000060
§ 371 (c)(1),
(2) Date: Jan. 19, 2018

(87) PCT Pub. No.: WO2017/015677
PCT Pub. Date: Jan. 26, 2017

(65) Prior Publication Data

US 2018/0230801 A1 Aug. 16, 2018

(30) Foreign Application Priority Data

Jul. 21, 2015 (IN) ..... 2204/DEL/2015

(51) Int. Cl.
*E21D 21/00* (2006.01)
*E21D 20/00* (2006.01)
*E21D 20/02* (2006.01)

(52) U.S. Cl.
CPC ..... *E21D 21/0033* (2013.01); *E21D 21/0046* (2013.01); *E21D 20/003* (2013.01); *E21D 20/02* (2013.01)

(58) Field of Classification Search
CPC ..... E21D 21/0033; E21D 21/0046; E21D 20/003; E21D 20/02
See application file for complete search history.

(56) References Cited

U.S. PATENT DOCUMENTS 2,525,198 A * 10/1950 Beijl ..... E21D 21/008 405/259.3
4,314,778 A * 2/1982 Cantrel ..... E21D 21/004 405/259.3

(Continued)

FOREIGN PATENT DOCUMENTS

AU 20201 95 11/1995
WO WO 2008/019432 2/2008

(Continued)

OTHER PUBLICATIONS

International Search Report, PCT/ZA2015/000060, dated Mar. 21, 2016.

*Primary Examiner* — Benjamin F Fiorello
(74) *Attorney, Agent, or Firm* — Young & Thompson

(57) ABSTRACT

A friction bolt assembly includes: an expansible sleeve having a tubular body between leading and trailing ends, which body has a longitudinally extending formation about which the body resiliently deforms and which formation extends along at least part of the body, ending at the body leading end; a rod extending through the sleeve body and between first and second ends and on which a projecting part is defined between the trailing end of the sleeve body and the second end; an expansion element on the rod at the first end; a first load bearing formation on the projecting rod part, moveable along the projecting part to abut the sleeve trailing end; a load applicator on the projecting part of the rod; and a second load bearing formation mounted over the projecting part of the rod between the first load bearing formation and the load applicator unit.

20 Claims, 6 Drawing Sheets

(56) References Cited

U.S. PATENT DOCUMENTS

| | | | | | |
|---|---|---|---|---|---|
| 4,472,087 | A * | 9/1984 | Elders | E21D 21/004 | 405/259.3 |
| 4,490,074 | A * | 12/1984 | Chaiko | E21D 21/0006 | 405/259.1 |
| 4,861,197 | A * | 8/1989 | Calandra, Jr. | E21D 21/0026 | 405/259.3 |
| 4,904,123 | A * | 2/1990 | Calandra, Jr. | E21D 21/008 | 405/259.3 |
| 5,295,768 | A * | 3/1994 | Buchhorn | E21D 21/0086 | 405/259.1 |
| 5,599,140 | A * | 2/1997 | Wright | E21D 20/025 | 405/259.3 |
| 6,779,950 | B1 * | 8/2004 | Hutchins | E21D 21/0026 | 405/259.1 |
| 2002/0094240 | A1 * | 7/2002 | Cook | E21D 21/008 | 405/259.4 |
| 2007/0031196 | A1 | 2/2007 | Bruneau | | |
| 2007/0196183 | A1 * | 8/2007 | Valgora | E21D 21/004 | 405/259.3 |
| 2009/0003940 | A1 * | 1/2009 | Oldsen | E02D 5/80 | 405/288 |
| 2011/0311315 | A1 * | 12/2011 | Evans | E21D 21/0033 | 405/259.3 |
| 2012/0163924 | A1 * | 6/2012 | Rataj | E21D 21/0033 | 405/259.3 |
| 2013/0115013 | A1 * | 5/2013 | He | E02D 5/74 | 405/259.3 |

FOREIGN PATENT DOCUMENTS

| | | | | |
|---|---|---|---|---|
| WO | WO 2015/013743 | | 2/2015 | |
| WO | WO-2015085349 | A1 * | 6/2015 | E21D 21/0033 |

* cited by examiner

RADIALLY EXPANSIBLE ROCK BOLT

BACKGROUND OF THE INVENTION

The invention relates to an improvement or modification to, or development on, a mechanically anchored rock bolt as described in the specification to South African patent no. 2012/07431, which is hereinafter referred to as the parent specification and which specification is herein incorporated by reference.

The rock bolt described in the parent specification is a bolt that relies, initially, on passive frictional engagement with the rock hole walls when inserted and then by a longitudinally directed pulling force, on the tendon, to cause the expansion element to enter into the tubular body to cause radial expansion and therefore mechanically aided additional purchase on the rock hole walls.

Actuation in this manner is suitable when an end of the tendon or rod is adapted with a hook or loop. Such a rod is unsuitable for actuation by a rotational drive means. Such means are prevalent in the mining environment.

The present invention at least partially addresses the aforementioned problem.

SUMMARY OF INVENTION

The invention provides a friction bolt assembly which includes:

an expansible sleeve having a tubular body longitudinally extending between a leading end and a trailing end, which body has a longitudinally extending formation about which the body resiliently deforms and which formation extends along at least part of the body, ending at the body leading end;

a rod which longitudinally extends through the sleeve body and between first end and a second end and on which a projecting part is defined between the trailing end of the sleeve body and the second end;

an expansion element mounted on or integrally formed with the rod at or towards the first end;

a first bad bearing formation mounted on the projecting part of the rod and which is moveable along the projecting part to abut the trailing end of the sleeve;

a bad applicator means mounted on the projecting part of the rod between the first bad bearing formation and the second end;

a second bad bearing formation mounted over the projecting part of the rod between the first bad bearing formation and the bad applicator means;

wherein the bad applicator means may be actuatable on contact with the second load bearing formation, when the second load bearing formation is in bearing engagement with a rock face to be supported and when the first load bearing formation is in bearing engagement with the trailing end of the sleeve body, to draw the expansion element into and through the sleeve body from the trailing end to cause the tubular body to radially outwardly deform about the longitudinally extending formation.

The longitudinally extending formation may be a channel formed in a wall of the body or a slit.

The rod may include a grout bore that is longitudinally co-extensive with the rod and which opens at each of the first and the second ends.

The rod may include a plurality of resistive formations formed on its exterior along a portion of the rod which is found, at least, within the sleeve.

The projecting part of the rod may be at least partially threaded.

The expansion element may have a tapered surface which engages with the sleeve body and which tapers towards the second end of the rod.

The expansion element may be frusto-conical in shape.

The expansion element may be located at or towards the first end of the rod. Preferably, the element is located at the first end.

The first load bearing formation may be an adapted nut which is threadedly engaged with the projecting part of the rod.

The nut may have a barrel shaped body which is conically or spherically shaped at an end that abuts the trailing end of the sleeve.

The load applicator means may include unitary body with a drive head surface and an abutting spherical seat. The drive head surface may be a hex-drive surface.

Alternatively, the load applicator means may separately include a nut with the hex-drive surface and a barrel having, at one end, an abutting spherical seat.

The second load bearing formation may be a rock face engaging washer or faceplate.

The invention extends to a method of installing the friction bolt assembly as described above in load support of a rock face, the method including the steps of:

a) inserting the friction bolt assembly at least partially into a pre-drilled rock hole in the rock face, first end leading, until the sleeve and the first load bearing formation, abutting the trailing end of the sleeve, are fully received in the rock hole;

b) spinning the load applicator means to move the second load bearing formation into abutment with the rock face;

c) torqueing the load applicator means to actuate the rod to move relatively to the sleeve to draw the expansion element into bearing engagement with the sleeve such that the first load bearing formation engages with the sleeve at the trailing end in friction fit; and d) torqueing the load applicator means to actuate the rod to move relatively to the sleeve to draw the expansion element into or within the sleeve to cause the sleeve body to radially outwardly deform about the longitudinally extending formation into frictional engagement with the walls of the rock hole and to cause the second load bearing formation into load bearing engagement with the rock, face.

The method may include the additional step, after step (d), of pumping a grout material into the grout bore of the rod at the second end until the grout material flows from the first end of the bore into the rock hole.

In the event that there is disintegration of the rock face adjacent the rock hole, step (b) of the method can be repeated followed by step (d).

BRIEF DESCRIPTION OF THE DRAWINGS

The invention is described with reference to the following drawings in which.

DESCRIPTION OF PREFERRED EMBODIMENTS

Figure 1:
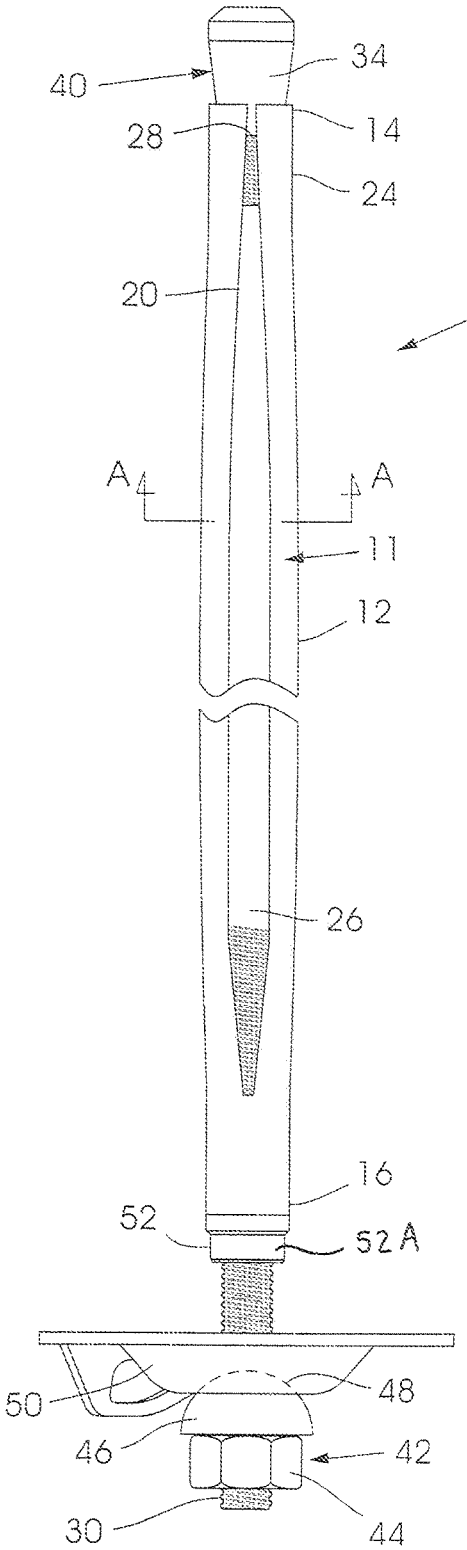
FIG. 1 is a front elevation view of a friction bolt assembly in accordance with a first embodiment of the invention.
Figure 2:
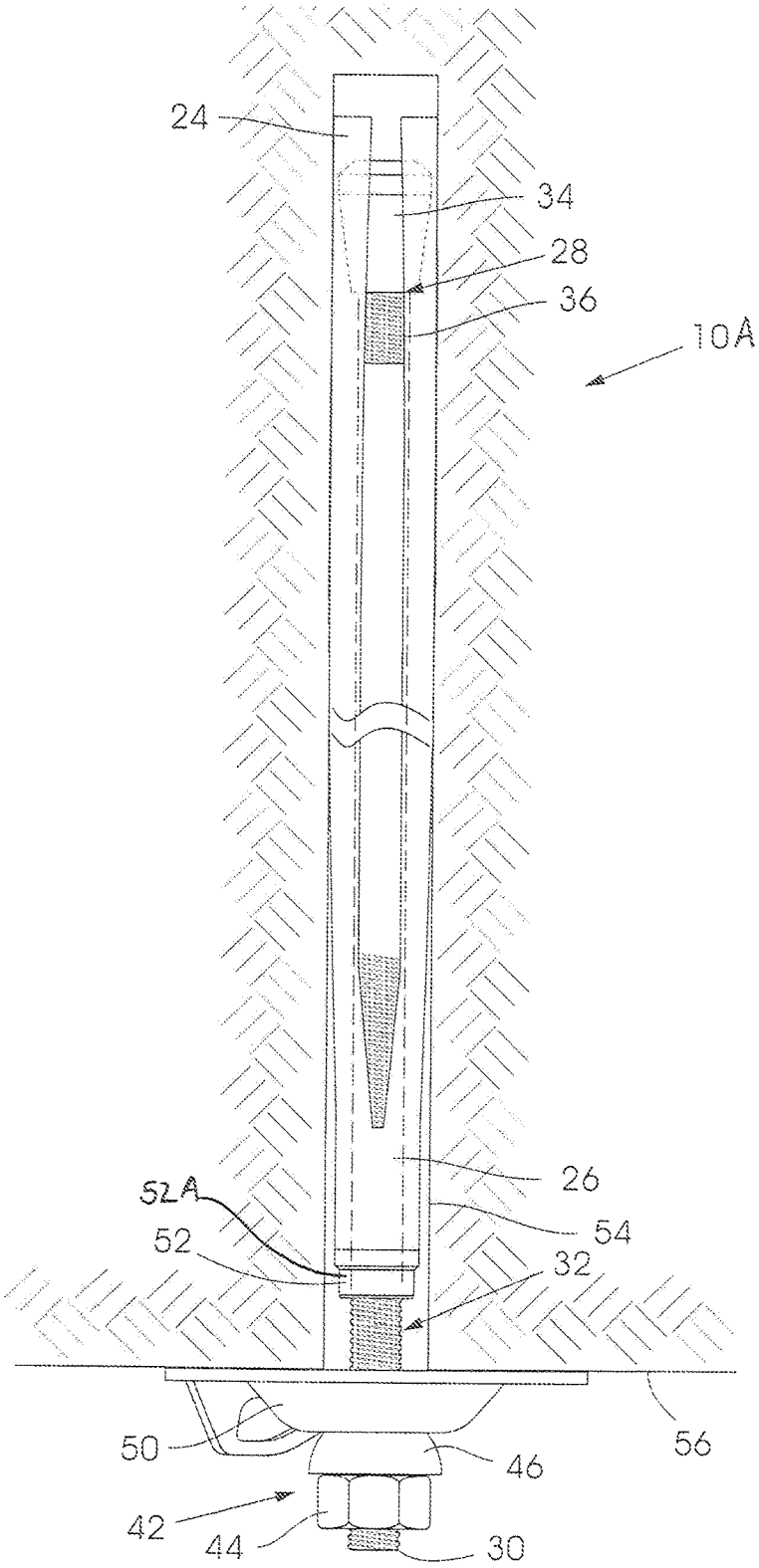
FIG. 2 is a front elevation view of the friction bolt assembly of FIG. 1 inserted in a rock hole.
Figure 3:
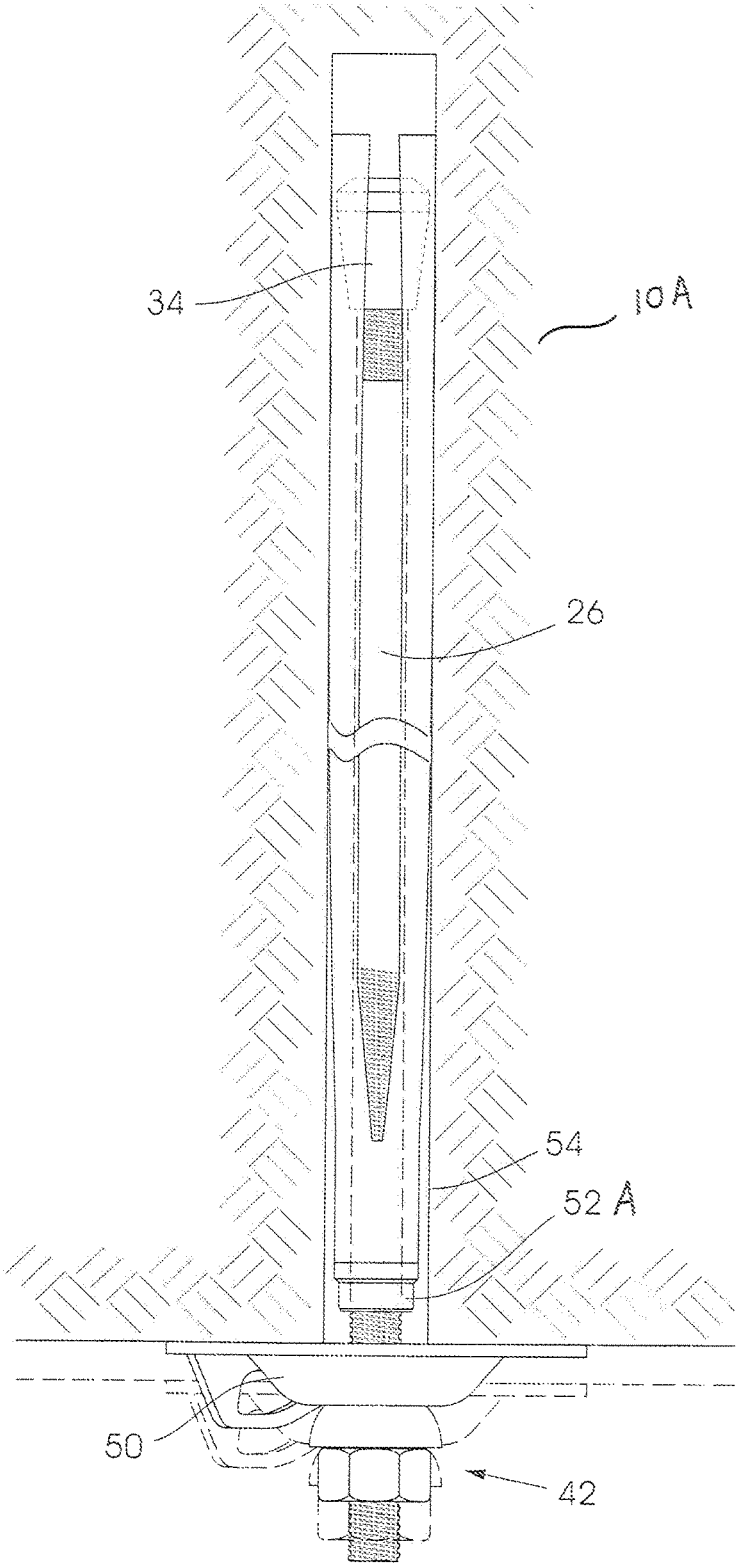
FIG. 3 is a front elevation view of the friction bolt assembly of FIG. 1 inserted in a rock hole, illustrating the ability of the assembly to be re-tensioned.

A friction bolt assembly 10A according to a first embodiment of the invention is depicted in FIGS. 1 to 3 of the accompanying drawings.

Figure 1A:
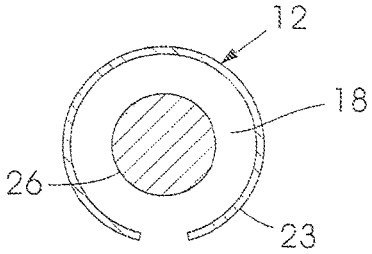
FIG. 1*a* is a sectional view of FIG. 1 taken at the line A-A.

The friction bolt assembly 10A has an expansible sleeve 11 having a generally tubular body 12 that longitudinally extends between a leading end 14 and a trailing end 16. Within the friction bolt body a cavity 18 is defined (see FIG. 1A). The body 12 has, in this particular embodiment, a slit 20 extending along the body from a point of origin towards the trailing end 16 and ending at the leading end 14. The slit accommodates radial compression of the tubular sleeve body in the usual manner when inserted in a rock hole as will be more fully described below.

The feature of the slit 30 is non-limiting and it is envisaged, within the scope of the invention, that a longitudinally extending formation about which the body is adapted to resiliently deform can be a channel or indented formation formed in a wall 23 of the body 12.

The sleeve body 12 has a slightly tapered leading portion 24 that tapers toward the leading end 14 to enable the sleeve 11 to be driven into the rock hole having a smaller diameter than the body. The thickness of the wall 23 of the sleeve body 12 is approximately 3 mm, made of structural grade steel.

The friction bolt assembly 10A further includes an elongate rod 26 (best illustrated in FIG. 2 partially in dotted outline) which longitudinally extends between a first end 28 and a second end 30. The rod is located partly within the cavity 18 of the sleeve body and partly outside of the sleeve where it extends beyond a trailing end 16 of the sleeve body as a projecting part 32. The projecting part is threaded.

An expansion element 34 is mounted on the rod 26 at a first end 28. In this example, the expansion element 34 is threadingly mounted onto a threaded leading portion 36 of the rod 26, received within a threaded aperture (not illustrated) of the expansion element 34. The expansion element 34 takes on the general frusto-conical form, with an engagement surface 40 that generally tapers towards the leading end 14 of the sleeve body. The maximum diameter of the expansion element is greater than the internal diameter of the sleeve body 12.

The friction bolt assembly 10A further comprises a load application means 42 mounted on the projecting part 32 of the rod 26, towards the rod's second end 30. In the particular embodiment depicted, the means 42 includes a hexagonal nut 44 that is threadingly mounted on the part 32 and a barrel 46 which has a central bore for mounting on the projecting part 32 of the rod. The barrel 46 presents a leading spherical or domed seat 48. On the threaded projecting part 32, between the barrel 46 of the load application means 42 and the sleeve body trailing end 16, a domed face plate 50 is mounted.

The friction bolt assembly 10A further includes a fitting 52. In this embodiment, the fitting is a cup-shaped retaining nut 52A which has a profiled leading end which receives the trailing end 16 of the sleeve 11.

Figure 4:
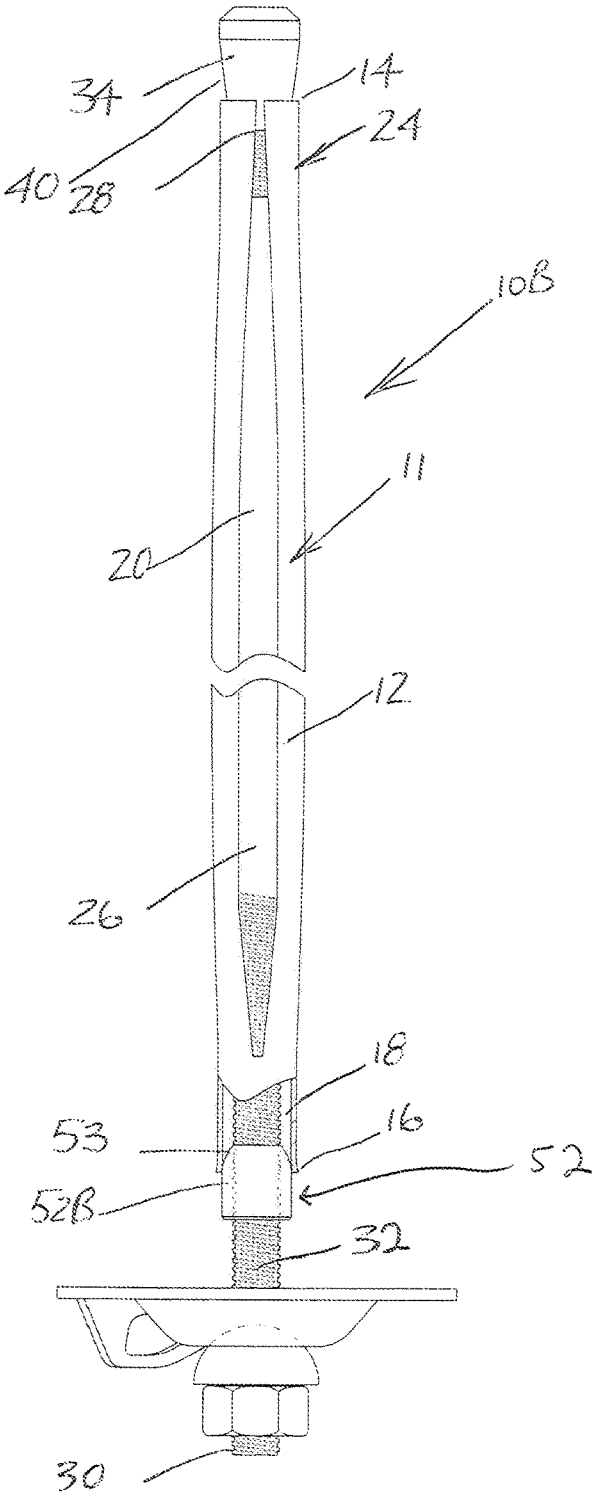
FIG. 4 is a front elevation view of a friction bolt assembly in accordance with a second embodiment of the invention which differs from the first embodiment in a shape of a load bearing nut of the assembly.

In a second embodiment of the assembly 10B illustrated in FIG. 4, the fitting 52 is a barrel shaped retaining nut 52B which has a spherical leading end 53. The benefit of the latter form of the fitting 52 will be described below.

In both embodiments, the fitting 52 is threadedly engaged with the projecting part 32, between the sleeve body trailing end 16 and the face plate 50. The fitting 52 is turned on the rod projecting part 32 to advance into contact with the trailing end 16. The fitting 52 maintains the initial positioning of the sleeve body 12, relatively to the rod 26, with the leading end 14 abutting the expansion element 40 and, in use of the assembly 10, becomes load bearing.

In use, the assembly 10 is installed in a rock hole 54 predrilled into a rock face 56 on which adjacent rock strata requires to be stabilized. See FIG. 2. The rock hole 54 will be of a diameter that is slightly smaller than the diameter of the body 12 of the sleeve 11, although greater than the maximum diameter of the expansion element 34 to allow insertion of the assembly 10 into the rock hole unhindered by the expansion element 34 which leads. The sleeve body 12 compressively deforms, allowed by the slit 20, to accommodate passage into the rock hole 54. Initially, the frictional forces due to the interference fit between the sleeve body 12 and the rock hole walls retain the friction bolt assembly 10 in the hole, and allow for the transfer of partial load from the rock strata about the rock face 56 to the sleeve body 12.

The assembly 10 is fully and operationally installed in the rock hole 54 when both the sleeve 11 and the fitting 52 are contained therein and a length of the projecting part 32 of the rod 26 extends from the rock hole 54. On this length the face plate 50 and the load application means 42 are mounted, allowing the face plate 50 a degree of longitudinal movement between the rock face 56 and the trailing position of the barrel 46. This feature ensures that the face plate 50 will always be contactable with the rock face 36 so that most of the load applied to the assembly 10 will be directed as preload to the rock face. This feature will be more fully described below.

Anchoring of the sleeve body 12 in the rock hole 50, additional to that provided passively by frictional fit is achieved by pull through of the expansion element 34 within the sleeve body 12 which provides a point anchoring effect. This is achieved by actuating the load application means 42 by applying a drive means (not shown) to spin and then torque the hex nut 44 as described below.

The initial spinning results in the nut 44 advancing along the threaded projecting part 32 towards the faceplate 50 to push the faceplate 50 into abutment with the rock face 56.

Due to opposed thread direction of the leading end portion 36 and the projecting part 32 of the rod, this rotation does not lead to disengagement of the rod with the expansion element 34.

Torqueing of the hex nut 44, now abutting the faceplate 50, will draw the threaded projecting part 32 of the rod 26 through the nut and pull the attached expansion element 34 against the leading end 14 of the sleeve body 12. Reactively, as the hex nut 44 is torqued, the faceplate 50 is drawn and held in progressive and proportional load support with the rock face 56.

Before the expansion element 34 moves into the cavity 18, the element contacts the leading end 14 of the sleeve body 12 in bearing engagement which causes the trailing end of the sleeve to reactively engage the fitting 52. The fitting 52, now in load support of the sleeve 12, prevents the sleeve 11 from diving way longitudinally relatively to the rod 26 under the force of the expansion element 34.

With the fitting being the barrel shaped nut 52B, depicted in FIG. 4, bearing engagement of the sleeve 11 on the nut 52B causes the walls at the trailing end 16 to resiliently deform outwardly over the spherical leading end 53 of the nut 52B. In this manner, the nut 52B is frictionally engaged with the sleeve 11 such that rotation of the sleeve is resisted under further torqueing action of the hex nut 44.

With the sleeve 11 held stationary relatively to the rod 26, the engagement surface 40 of the expansion element engages the sleeve body 12 at the leading end and forces the body 12 at this end into radially outward deformation. Ultimately, the expansion element 34 is caused to be drawn fully into the tapered leading portion 24 of the sleeve body 12, as illustrated in FIGS. 2 and 3, which is radially outwardly deformed along the path of ingress to accommodate the passage of the element 34. The radial outward deformation forces the sleeve body 12 into frictional contact with the rock hole 54. This action achieves point anchoring of the sleeve body 12, and thus the bolt assembly 10, within the rock hole.

Figure 5:
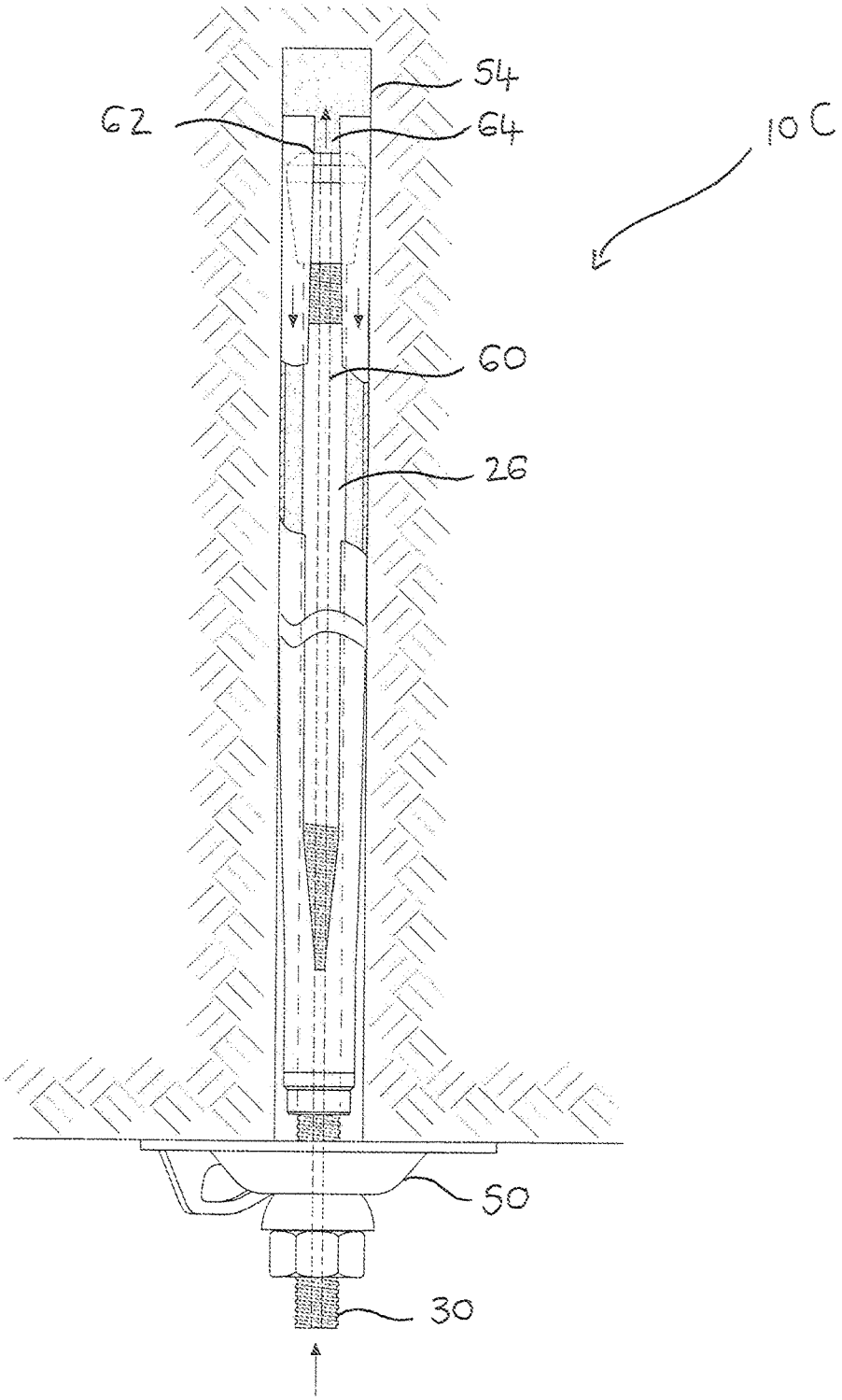
FIG. 5 is a front elevation view of a friction bolt assembly in accordance with a third embodiment of the invention which differs from the first embodiment in a rod of the assembly having a grout bore.

To prevent or control relative movement of the rod 26 with the sleeve 11, caused passively by rock dynamics and the stretching of the rod 26 between the location of point anchoring and the faceplate 50, the rod and the expansion element 34 is provided with a grout bore 60. The bore 60 longitudinally extends through the rod 26 and the element to open at rod ends 28 and a leading end 62 of the element. Thus the bored rod provides, in a third embodiment of the assembly 10C (illustrated in FIG. 5) a grouted application.

Grout, from a source (not shown) is pumped through the bore 60, from the second end 30, to flow into a blind end of the rock hole 54 from the leading end 62 of the expansion element 34. From there, with further grout inflow, inflowing the grout seeps downwardly into a channel 64 provided by the slit 20 which provides a conduit to the sleeve cavity 18. In the cavity 18, the grout hardens and adheres the rod 26 to an interior surface of the sleeve body.

With a smooth exterior of the rod 26, movement of the rod 26 within the sleeve 11 by stretch under load, will occur but to a lesser extent than in the grout unsupported applications of the earlier embodiments.

Figure 6:
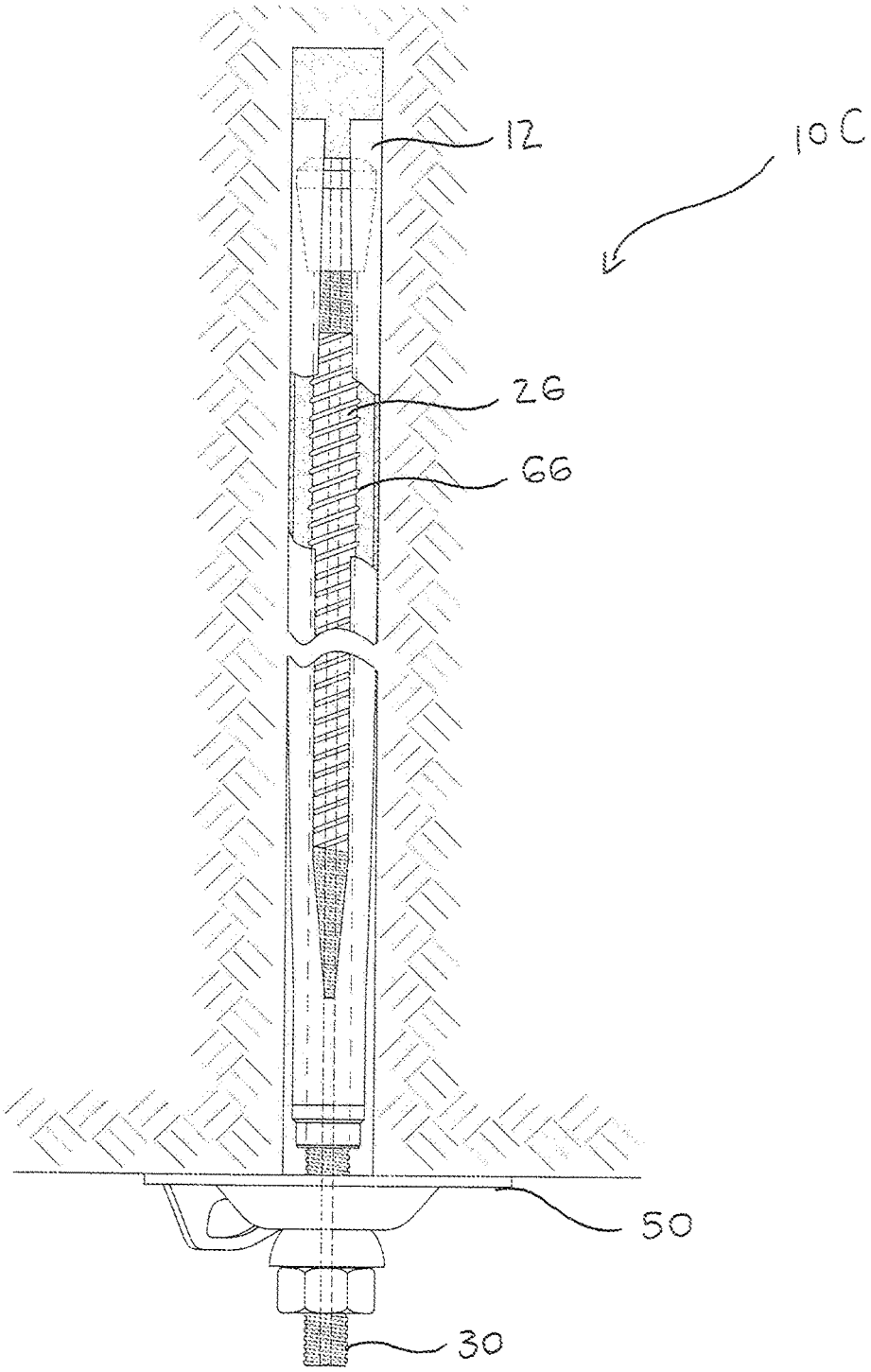
FIG. 6 is a front elevation view of a friction bolt assembly in accordance with a fourth embodiment of the invention which differs from the third embodiment in the rod being externally corrugated.

To further reduce or eliminate this movement, thus creating a rigid friction bolt installation, the rod 26 can be provided exteriorly with a plurality of corrugations 66 (see FIG. 6). The corrugations 66 are resistive to the movement of the rod 26 through the grout. Reduction in this movement which translates to increased rigidity, can be provided in an increased density of the corrugations 66 formed on the rod 26.

Over time, the rock strata underlying the rock face 56 can fragment and scale from the rock face 56. Due to the projecting part 32 of the rod, and the space this feature creates between the faceplate 50 and the sleeve, there is a capacity for re-tensioning of the assembly 10 spinning off the nut 44 in order to drive the faceplate 48, once again, into contact with the now retreated rock face 56. This action is illustrated in FIG. 3 and is performed in order to ensure that the tension is reinstated in the assembly 10, and thereby reintroducing the supporting reaction force through the faceplate 50 into the rock face 56.

In the embodiments described above, the sleeve 11 and the rod 26 are typically made of structural grade steel. This is non-limiting to the invention as it is envisaged that at least the sleeve 11 and the rod 26 can also be made of a fibre reinforced plastic (FRP) such as, for example, pultruded fibreglass. It is further anticipated that ail of the components of the components of the friction bolt assembly 10 can be made of a FRP.

The invention claimed is:

1. A friction bolt assembly, comprising:

an expansible sleeve having a tubular body of a steel material that longitudinally extends between a leading end and a trailing end, said body having a longitudinally extending formation that extends along at least part of a length of the body and ending at the leading end of the body;

a rod which longitudinally extends through the sleeve body between a first end and a second end and on which a projecting part is defined between the trailing end of the sleeve body and the second end;

an expansion element mounted on or integrally formed with the rod at or towards the first end;

a first load bearing formation mounted on the projecting part of the rod and which is moveable along the projecting part to abut the trailing end of the sleeve;

a nut mounted on the projecting part of the rod between the first load bearing formation and the second end; and a second load bearing formation mounted over the projecting part of the rod between the first load bearing formation and the nut;

wherein the body is radially compressible so as to radially compress about the longitudinally extending formation when the bolt is inserted into a rock hole, wherein the nut is actuatable on contact with the second load bearing formation, when the second load bearing formation is in bearing engagement with a rock face to be supported and when the first load bearing formation is in bearing engagement with the trailing end of the sleeve body, to draw on the rod to pull the expansion element into and through the sleeve body from the trailing end to cause the tubular body to radially outwardly deform about the longitudinally extending formation, and wherein the sleeve is prevented from giving way longitudinally relatively to the rod, under the force of the expansion element, by the first load bearing formation.

2. The friction bolt assembly according to claim 1, wherein the longitudinally extending formation is a channel formed in a wall of the body or a slit.

3. The friction bolt assembly according to claim 2, wherein the rod includes a grout bore that is longitudinally co-extensive with the rod and which opens at the first end and the second end.

4. The friction bolt assembly according to claim 2, wherein the rod includes a plurality of resistive formations on an exterior of the rod along a portion of the rod which is found, at least, within the sleeve.

5. The friction bolt assembly according to claim 2, wherein the projecting part of the rod is at least partially threaded.

6. The friction bolt assembly according to claim 1, wherein the rod includes a grout bore that is longitudinally co-extensive with the rod and which opens at the first end and the second end.

7. The friction bolt assembly according to claim 6, wherein the rod includes a plurality of resistive formations on an exterior of the rod along a portion of the rod which is found, at least, within the sleeve.

8. The friction bolt assembly according to claim 6, wherein the projecting part of the rod is at least partially threaded.

9. The friction bolt assembly according to claim 1, wherein the rod includes a plurality of resistive formations on an exterior of the rod along a portion of the rod which is found, at least, within the sleeve.

10. The friction bolt assembly according to claim 1, wherein the projecting part of the rod is at least partially threaded.

11. The friction bolt assembly according to claim 1, wherein the expansion element has a tapered surface which engages with the sleeve body and which tapers towards the second end of the rod.

12. The friction bolt assembly according to claim 1, wherein the expansion element is located at or towards the first end of the rod.

13. The friction bolt assembly according to claim 1, wherein the first load bearing formation is an adapted nut which is threadedly engaged with the projecting part of the rod.

14. The friction bolt assembly according to claim 13, wherein the adapted nut has a barrelled body which is conically or spherically shaped at an end that abuts the trailing end of the sleeve.

15. The friction bolt assembly according to claim 1, further comprising:

a barrel on the rod between the nut and the second load bearing formation having, at one end, an abutting spherical seat.

16. The friction bolt assembly according to claim 1, wherein the second load bearing formation is a rock face engaging washer.

17. A method of installing the friction bolt assembly according to claim 1 in load support of a rock face, the method comprising the steps of:

a) inserting the friction bolt assembly at least partially into a pre-drilled rock hole in the rock face, first end leading, until the sleeve and the first load bearing formation, abutting the trailing end of the sleeve, are fully received in the rock hole;

b) spinning the nut to move the second load bearing formation into abutment with the rock face;

c) torqueing the nut to actuate the rod to move relatively to the sleeve to draw the expansion element into bearing engagement with the sleeve such that the first load bearing formation engages with the sleeve at the trailing end in friction fit; and d) torqueing the nut further to actuate the rod to move relatively to the sleeve to draw the expansion element into or within the sleeve to cause the sleeve body to radially outwardly deform about the longitudinally extending formation into frictional engagement with the walls of the rock hole and to cause the second load bearing formation into load bearing engagement with the rock face.

18. The method according to claim 17, wherein steps (b) and (d) are repeated in the event that there is disintegration of the rock face adjacent the rock hole.

19. A method of installing the friction bolt assembly according to claim 6 in load support of a rock face, the method comprising the steps of:

a) inserting the friction bolt assembly at least partially into a pre-drilled rock hole in the rock face, first end leading, until the sleeve and the first load bearing formation, abutting the trailing end of the sleeve, are fully received in the rock hole;

b) spinning the nut to move the second load bearing formation into abutment with the rock face;

c) torqueing the nut to actuate the rod to move relatively to the sleeve to draw the expansion element into bearing engagement with the sleeve such that the first load bearing formation engages with the sleeve at the trailing end in friction fit; and d) torqueing the nut further to actuate the rod to move relatively to the sleeve to draw the expansion element into or within the sleeve to cause the sleeve body to radially outwardly deform about the longitudinally extending formation into frictional engagement with the walls of the rock hole and to cause the second load bearing formation into load bearing engagement with the rock face.

20. The method according to claim 19, further comprising:

after step (d), pumping a grout material into the grout bore of the rod at the first end until the grout material flows from the second end of the bore into the rock hole.

* * * * *